United States Patent [19]

Zaruba et al.

[11] Patent Number: 4,518,367

[45] Date of Patent: May 21, 1985

[54] FIGURE INCLUDING MEANS FOR EXTRUDING PLASTIC SUBSTANCE

[75] Inventors: John V. Zaruba, Chicago; Burton C. Meyer, Downers Grove, both of Ill.

[73] Assignee: Marvin Glass & Associates, Chicago, Ill.

[21] Appl. No.: 543,408

[22] Filed: Oct. 19, 1983

[51] Int. Cl.[3] ..... A63H 3/36

[52] U.S. Cl. ..... 446/373; 446/267; 446/320; 446/327; 446/339; 446/382; 446/385; 446/391; 446/475; 425/190; 425/542; 425/DIG. 57

[58] Field of Search ..... 446/267, 268, 319–321, 446/327, 330, 337, 339, 341, 372, 373, 376, 382, 385, 391, 475, 489; 425/DIG. 57, 190, 542

[56] References Cited

U.S. PATENT DOCUMENTS

| | | | |
|---|---|---|---|
| 2,578,105 | 12/1951 | Taylor | 425/DIG. 57 |
| 2,927,543 | 3/1960 | Sherbondy | 425/190 |
| 3,009,267 | 11/1961 | Bezark | 446/373 |
| 3,061,880 | 11/1962 | Weisbach | 425/DIG. 57 |
| 3,157,933 | 11/1964 | Boggild et al. | 425/DIG. 57 |
| 3,685,936 | 8/1972 | Meth et al. | 425/DIG. 57 |

FOREIGN PATENT DOCUMENTS

| | | | |
|---|---|---|---|
| 2050235 | 1/1981 | United Kingdom | 425/DIG. 57 |

*Primary Examiner*—F. Barry Shay
*Attorney, Agent, or Firm*—John S. Pacocha

[57] ABSTRACT

An activity toy including a hollow skull extending from a hollow, tubular neck and having eye, nose, and mouth openings. Attachable about and spaced from the skull in relatively tight relation to the neck is a clear face and head mask formed of separable halves secured together by clamps. A plastic amorphous solid substance is loaded into the skull through the neck and extruded out of openings to fill the space between the skull and the mask. Removal of the mask permits further hand working of the plastic substance to modify the appearance of the formed face. Suitable appendages and a hooded cloak are provided to obscure the plastic substance extrusion mechanism and provide a figure that may be placed in combination with the face and head extruding feature.

11 Claims, 6 Drawing Figures

FIGURE INCLUDING MEANS FOR EXTRUDING PLASTIC SUBSTANCE

BACKGROUND OF THE INVENTION

1. Field of the Invention

This invention relates generally to toy figures and more particularly to a toy figure that is combined with a plastic substance extruder for forming the face and head of the figure.

2. Background Art

Figures and dolls have long been popular toys with both boys and girls. More recently, figures resembling monsters or fantasy characters have become very popular. Clay and other plastic substances have long provided children with entertaining activity including the sculpting of heads or faces. However, not all children have the innate artistic ability or talent to make a satisfying head or face. Prior art toys have provided children with mechanical molding means for clay or similar plastic substances such as in U.S. Pat. No. 3,685,936 to mold animal-like characters. Other toys such as LJN "Dr MAD'S HAIRY-SCARY MONSTERS" and KENNER "FUZZY PUMPER" pet shop have combined mechanical extruder bases with hollow apertured attachments for monster and animal-like figures for the purpose of extruding a mass of strands of a plastic substance to decorate the figure with "hair" or the like. There remains, however, a need for an activity toy that combines a figure with a self-contained extruding mechanism and provisions for molding a head and face that is operable during play with the figure in an entertaining way and which produces a result that is aesthetically pleasing to the child.

SUMMARY OF THE INVENTION

The present invention is ooncerned with providing a figure that includes a self-contained extruding mechanism and a mold for forming an aesthetically pleasing head and face for the figure in an entertaining manner. These and other objects and advantages of the invention are achieved by a figure that has a hollow skull extending from a tubular neck and having openings for the eyes, nose and mouth and which combines with a separable clear mask that is attached such that the mask is relatively tight about the neck but is spaced from the skull. The figure supports a mechanism for forcing a plastic amorphous solid substance loaded into the skull through the tubular neck out of the eye, nose, and mouth openings to fill the mask to form a face wth the substance. Separating and removing the mask permits further play with the formed face and head. The figure is provided with suitable appendages, which may interact with the extrusion mechanism, as well as a cloak or other covering to obscure the mechanism and permit additional play with the figure. A detachable cap is conveniently provided in the top of the skull to facilitate removal of the plastic substance from the interior of the skull.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
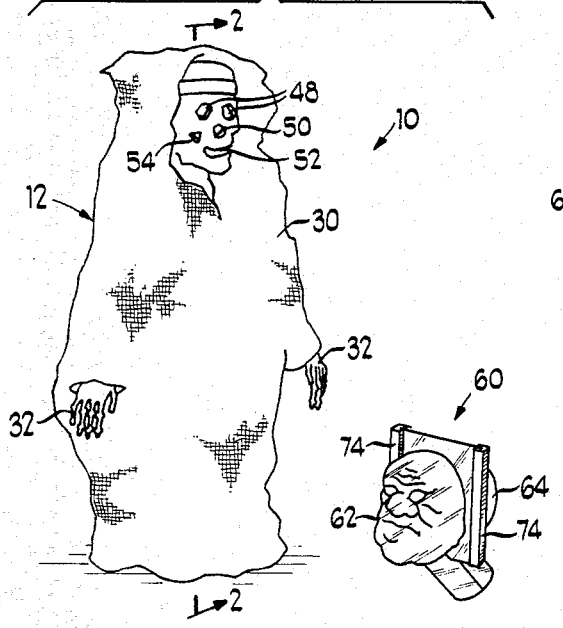
FIG. 1 is a perspective view of the cloaked figure plus the clear mask and extruder piston.
Figure 3:
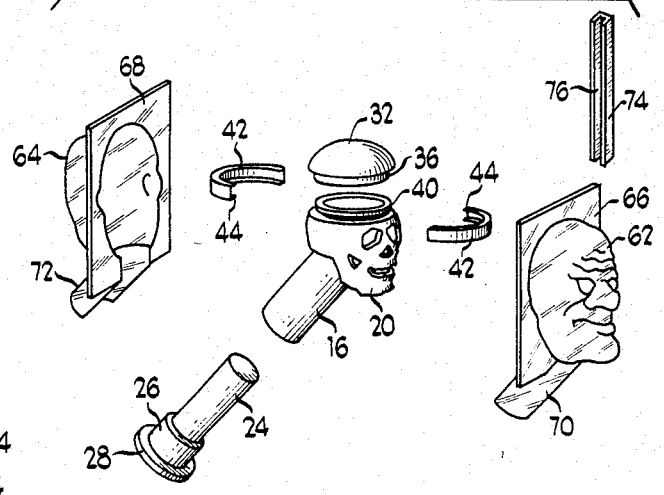
FIG. 3 is an enlarged scale exploded perspective view of the skull, mask and extruder piston.
Figure 2:
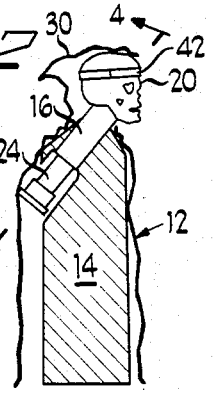
FIG. 2 is a reduced scale side elevational view partially in section along line 2—2 of FIG. 1.

Referring now to the drawing in which like parts are designated by like reference numerals throughout the several views, there is shown in FIG. 1 an activity toy 10 that includes a toy figure 12. In this embodiment the figure is somewhat simplified and has a generally cylindrical body 14. An upper member includes a tubular neck 16 mounted in the body at an angle of approximately 45 degrees to the vertical center of the body and has an upper outwardly extending end that supports a hollow skull 20. Both the neck tube 16 and the hollow skull 20 may be integrally formed with the body 14 or otherwise permanently mounted on the body. The open lower end of the tubular neck 16 receives a sliding extrusion piston 24 that has a shouldered portion 26 on the back end to prevent the piston being pushed all the way into the tubular neck 16. To facilitate pushing the piston with a thumb or finger a further enlarged portion 28 is provided behind the shouldered portion. As is best illustrated in FIG. 2, the piston 24 extends out of the back of the figure at a point below the shoulder so that the piston may be pushed into the neck 16 by the thumb of a hand grasping the body of the figure 12.

In order to provide a monster like appearance, the skull 20, neck 16, and body 14 are covered with a hooded cloak 30 which obscures the extrusion mechanism. Appendages, such as bony hands 32, extend from sleeves or openings in the cloak and may be attached directly to the cloak. Alternatively, the body 14 may be shaped to more closely conform to that of the monster or other fantasy character being represented. In addition, arms (not shown) could be attached to the body and through a suitable linkage (not shown) be used to operate the extrusion mechanism. Similarly, it will be apparent to those skilled in the art, that different types of extrusion mechanisms, such as a screw type extruder, could be used.

Hollow skull 20 may be integrally formed with the neck 16 and is provided with a detachable cap 32 for access of the interior of the skull for cleaning purposes. The cap and the skull are generally circular along the plane on which they abut. Spaced from the lower edge of cap 32 is a circular groove 34 below which depends a cylindrical wall portion 36 that is an integral part of the cap. A similar circular groove 38 is spaced from the top edge of the skull 20 a distance substantially equal to the spacing of the groove 34 from the bottom edge of the cap 32. Extending upwardly from the groove 38 is a circumferential wall 40. Opposed retaining "C" shaped bands 42 have inwardly directed flanges 44 which fit into the grooves 34 and 38 to secure the cap 32 and the skull 20 together. The size of the "C" shaped bands 42 is equal to or slightly smaller than the circumference of the cap and skull adjacent the plane of the attachment and the bands have sufficient resiliency so that the bands are retained in the grooves to keep the cap and skull together.

Figure 4:
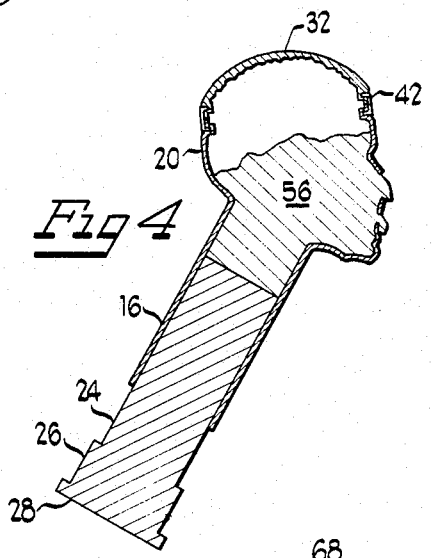
FIG. 4 is an enlarged scale sectional view taken generally along the line 4—4 of FIG. 2.
Figure 5:
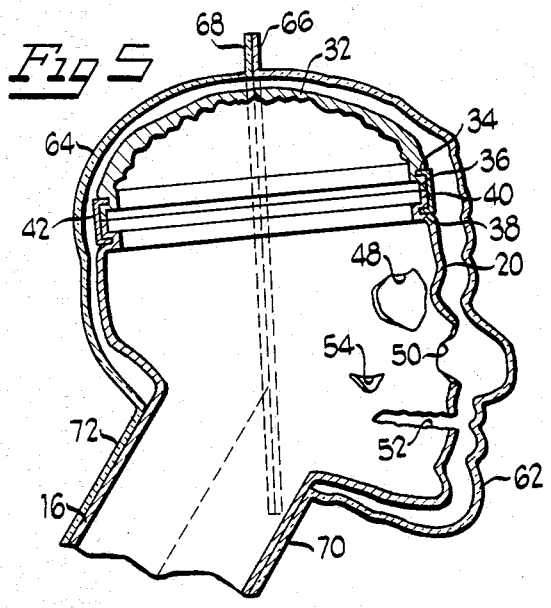
FIG. 5 is a further enlarged scale side elevational view in section generally through the center of the skull and neck with the mask attached.
Figure 6:
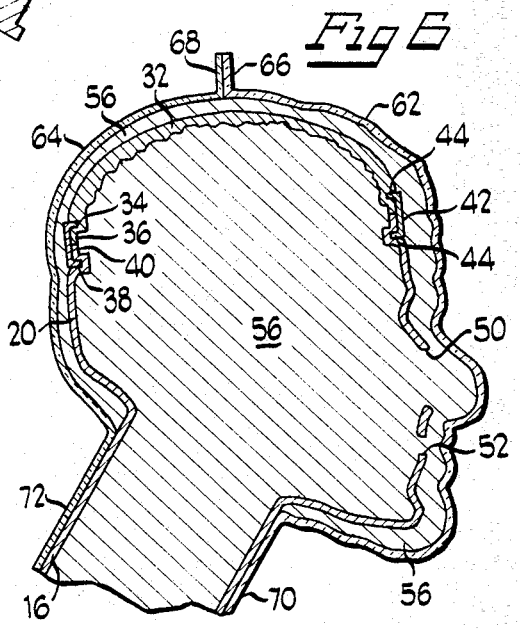
FIG. 6 is a sectional view similar to FIG. 5 with both the skull and mask filled with the plastic substance.

The front of skull 20 is provided with a number of openings representing eye sockets 48, nose cavity 50, mouth 52, and holes in the cheeks 54. Accordingly, the figure 12, as illustrated in FIG. 1, comprises a hooded, cloaked skeleton-like monster which may be played with like a conventional monster or fantasy figure. In addition, the interior of the skull 20 is loadable with a colored clay or other malleable amorphous solid 56 used by children for modeling and other activities. With the piston 24 inserted as shown in FIGS. 2 and 4, pushing the piston into the neck 16 with thumb or finger will cause some of the substance 56 to be extruded out of the openings in the skull.

A relatively rigid clear mask 60 is formed of two separable front and back halves 62 and 64, respectively, each having a substantially uniformed wall thickness. The front half 62 has the external appearance of a face and the interior forms a mold cavity for a face. Back half 64 forms the remainder of the head, both externally and internally. Halves 62 and 64 have a projecting plate 66 and 68, respectively, that lies in the generally vertical parting line plane. In addition, each portion has a respective downwardly extending semi-cylindrical front sleeve 70 and back sleeve 72.

When abutted, sleeves 70 and 72 conform substantially to the outer dimension of the tubular neck 16 creating a relatively tight fit about the neck. The rectangular plates 66 and 68 are of substantially identical outer dimensions so that when the two halves 62 and 64 of the mask 60 are assembled with the edges of the rectangular plates aligned, the sleeves 70 and 72 fit about the neck 16. Clamps 74 placed over the side edges of the joined plates 66 and 68 secure the two separable halves together. As with the "C" shaped bands 42 the rectangular clamps 74 are formed of a resilient material and have a slot 76 that is slightly narrower than the combined thicknesses of the plates 66 and 68 to retain the clamps 74 in place. Because the lower side edges of the rectangular plates extend down below the face and head to intersect an upper portion of the sleeves, the clamps 74 also sufficiently secure the top of the sleeves 70 and 72 about the neck 16.

With the detachable cap 32 on and the separable halves 62 and 64 clamped together about the neck 16 to form mask 60, plastic substance 56 extruded out of the hollow skull 20 through the openings 48, 50, 52, and 54 fills the annular space between the skull 20 and the interior of the mask 60 to form a face and head for the figure 12. In order to facilitate putting the mask on, the hood portion of the cloak 30 may be flipped off the skull, and after the mask is in place flipped back up to substantially hide the clamped parting plates 66 and 68. Once the face and head has been formed by pushing the piston 24 into the neck 16, the mask 60 may be removed and the child may further play with the face and head thus created. For example, a child could with fingers or othertools modify the formed face particularly in the region of the openings 48, 50, 52, and 54. Further pressure on the piston 24 will then cause additional material to be extruded out through the openings to expand and deform the already formed face and perhaps erupt out of the weakened regions.

While a particular embodiment of the invention has been shown an described with some modifications, it will be apparent to those skilled in the art that further changes and modifications may be made without departing from the invention. It is intended in the appended claims to cover all such changes and modifications that fall within the true spirit and scope of the invention.

What is claimed as new and desired to be secured by Letters Patent is:

1. An activity toy comprising:

a figure with a body supporting an upper member including a hollow skull;

extrusion openings in the skull in one or more of the eye, nose, and mouth areas;

a loading opening for inserting a plastic substance into the hollow skull;

extrusion means cooperating with the loading opening in said member for forcing the plastic substance into the hollow skull and out of the extrusion openings; and a removable clear mask, means for attaching the mask about the skull with the interior of the mask spaced from the skull in the area of the openings and in a relatively tight fit with another portion of the member to substantially prevent the flow of the plastic substance out of the mask.

2. The activity toy of claim 1 in which the extrusion mechanism is a sliding piston.

3. The activity toy of claim 2 in which the upper member includes a tubular neck which serves as the loading opening and to receive the sliding extrusion piston.

4. The activity toy of claim 1 in which the hollow skull includes a detachable cap remote from the loading opening, detachment of the cap providing access to the interior of the hollow skull for cleaning.

5. The activity toy of claim 4 including means for securing the cap and skull together.

6. The activity toy of claim 5 in which the securing means comprises a substantially "C" shaped band that fits into circumferential grooves on the cap and on the skull.

7. The activity toy of claim 1 in which the mask is formed of separable portions and includes clamping means for securing the portions together.

8. The activity toy of claim 7 in which the mask portions each have a projecting parting line plate and the clamping means fits over the abutting plates.

9. The activity toy of claim 1 including means compatible with the appearance of the character represented by the figure for obscuring the extrusion mechanism and mold mask attachment means.

10. The activity toy of claim 9 in which the obscuring means comprises a hooded cloak.

11. The activity toy of claim 1 in which the figure is provided with appendages.

* * * * *